US006585361B1

(12) United States Patent
Jones

(10) Patent No.: US 6,585,361 B1
(45) Date of Patent: Jul. 1, 2003

(54) MULTIPLE-CHAMBER CARTRIDGE WITH VARYING POROUS MEMBER COMPRESSION

(75) Inventor: Bruce S. Jones, Franklin, TN (US)

(73) Assignee: Seiko Epson Corporation, Nagano-Ken (JP)

( * ) Notice: Subject to any disclaimer, the term of this patent is extended or adjusted under 35 U.S.C. 154(b) by 0 days.

(21) Appl. No.: 10/148,981

(22) PCT Filed: Oct. 5, 2001

(86) PCT No.: PCT/US01/31279

§ 371 (c)(1),
(2), (4) Date: Jun. 4, 2002

(87) PCT Pub. No.: WO02/28650

PCT Pub. Date: Apr. 11, 2002

Related U.S. Application Data

(60) Provisional application No. 60/239,087, filed on Oct. 6, 2000.

(51) Int. Cl.[7] ..... B41J 2/175
(52) U.S. Cl. ..... 347/86
(58) Field of Search ..... 347/6, 7, 86, 87

(56) References Cited

U.S. PATENT DOCUMENTS

| | | | | |
|---|---|---|---|---|
| 5,222,824 A | * | 6/1993 | Nicoll et al. | 401/235 |
| 5,875,615 A | * | 3/1999 | Ito et al. | 53/474 |
| 6,170,941 B1 | * | 1/2001 | Hara et al. | 347/86 |
| 6,238,042 B1 | * | 5/2001 | Kobayashi et al. | 347/86 |

* cited by examiner

*Primary Examiner*—Anh T. N. Vo
(74) *Attorney, Agent, or Firm*—Squire, Sanders & Dempsey L.L.P.

(57) ABSTRACT

An ink tank cartridge (A) includes a housing (10) having a plurality of walls forming a cavity. Divider walls (22, 24) divide the cavity into first, second and third chambers (26, 29, 30). Removable spacers (40, 70, 90) further divide each chamber into substantially equally sized sub-chambers (42, 47, 48, 44, 45, 46). Ink absorbing members (100, 102, 104) are inserted into the sub-chambers. The ink absorbing members are compressed by the removable spacers to regulate the flow of ink therethrough. Each of the chambers is filled with inks of different viscosities. The ink absorbing members are compressed in proportion to the viscosity of the ink carried by the ink absorbing member.

18 Claims, 4 Drawing Sheets

MULTIPLE-CHAMBER CARTRIDGE WITH VARYING POROUS MEMBER COMPRESSION

CROSS-REFERENCE TO RELATED APPLICATIONS

This application claims priority from Provisional Application No. 60/239,087 filed on Oct. 6, 2000.

BACKGROUND OF THE INVENTION

This invention relates generally to the ink-jet printing art for ejecting ink droplets onto a recording medium such as paper, and more particularly, to an ink tank cartridge for use in an ink-jet type recording apparatus such as a printer.

In a conventional recording apparatus, ink is supplied to a recording head from an ink tank constructed as a cartridge. A benefit of using an ink cartridge serving as an ink tank is that ink does not smear due to the leakage of ink while refilling new ink or the like. Controlling the flow of ink from the cartridge is also a concern.

In a tri-color or a multi-color cartridge used with an ink-jet printer, a separate chamber is provided for each color, for example, cyan, magenta, and yellow ink. Each of the three chambers uses a separate ink color to feed the printhead. In most cases, each color ink has its own unique viscosity, different from the other inks which means that each ink flows at a different rate through the printhead. Accordingly, larger and smaller drop sizes are formed because of the different viscosity of the particular ink.

In a semi-free ink cartridge design that has a porous member compressed within a chamber, the porous members are typically of equal size and are compressed into each chamber the same amount. Because each foam block is compressed in the same proportion, and the ink viscosity is different for the different color inks, ink flow rate to the nozzle is unequal. This non-uniform drop size impacts on print quality.

Accordingly, a new and improved ink cartridge which would overcome these deficiencies and others while meeting the above-stated needs is desired.

SUMMARY OF THE INVENTION

Generally speaking, in accordance with the invention, an ink tank cartridge is provided for an ink-jet type recording apparatus removably mounted on the ink supply needle of a recording body.

More particularly, the invention relates to an ink tank cartridge for an ink-jet type recording apparatus having a housing including a plurality of walls forming a cavity. A divider wall divides the cavity into first and second chambers. A pair of removable spacers are inserted into each of the chambers and further divide each chamber into substantially equally sized smaller sub-chambers. Ink absorbing members are inserted into one of the sub-chambers of each chamber where the ink absorbing members are compressed by the spacers to regulate the flow of ink through the ink absorbing members. A second divider wall along with the first divider wall separates the cavity of the housing into first, second, and third chambers. A third spacer is inserted into the third chamber to divide it into substantially equally sized sub-chambers. An ink absorbing member is also installed into one of the sub-chambers of the third chamber.

Each removable spacer has a first leg, a second leg, and a wall hingedly connected between the legs. The legs are spaced apart and substantially parallel to each other. Each wall of the spacer has a notch for permitting ink flow between sub-chambers of a particular chamber. Each of the chambers is filled with an ink of different viscosities. The ink absorbing members are compressed in proportion to the viscosity of the ink carried by the ink absorbing member. The legs of the spacer in the chamber with the ink of highest viscosity have a longer length than legs of a spacer in a chamber of ink with lower viscosity. As a result, the longest length legs provide the greatest amount of compression for their corresponding ink absorbing member which carries ink of highest viscosity. In contrast, the shortest length legs provide the least amount of compression on their corresponding ink absorbing member which carries ink of lower viscosity.

Still other aspects of the invention will become apparent to those skilled in the art upon reading and understanding the following detailed description.

BRIEF DESCRIPTION OF THE DRAWINGS

The invention may take form in certain components and structures, a preferred embodiment of which will be illustrated in the accompanying drawings wherein.

DETAILED DESCRIPTION OF THE PREFERRED EMBODIMENT

Figure 1:
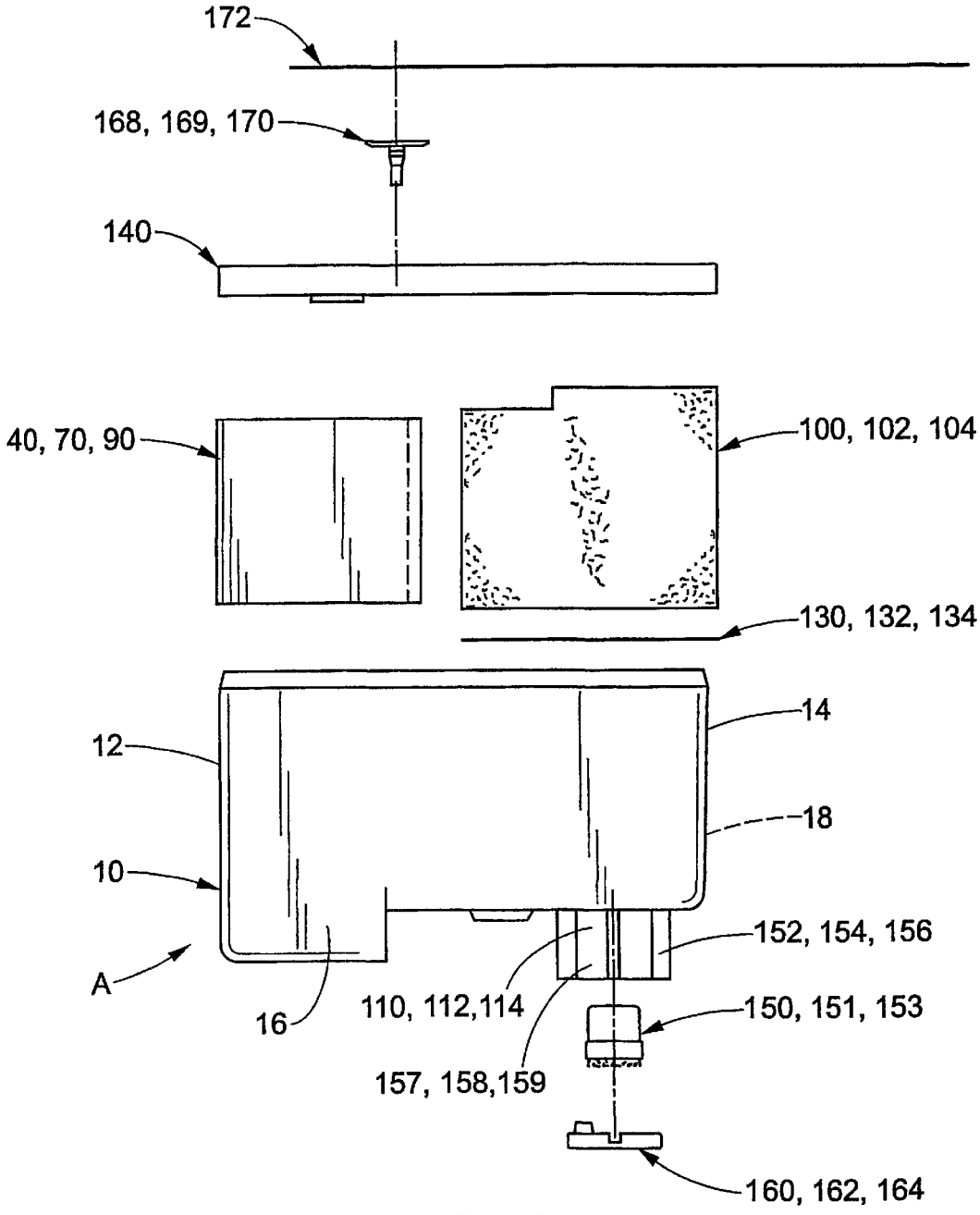
FIG. 1 is an exploded side elevational view of an ink cartridge according to a preferred embodiment of the present invention applied hereto.

Referring now to the drawings, wherein the showings are for purposes of illustrating a preferred embodiment of the invention only and not for purposes of limiting same, FIG. 1 shows an ink tank cartridge A according to the present invention.

More specifically, the ink tank cartridge A includes a case or housing 10 which defines an internal cavity of generally rectangular cross section. The outer portion of the housing is formed by a series of walls 12, 14, 16, 18, which form the internal cavity 20. Additional walls 22, 24 divide the internal cavity into three substantially equally sized smaller first, second and third chambers 26, 28, 30 (see FIG. 4). Walls 22, 24 extend laterally between opposed sides of the housing and extend upwardly from a bottom wall 32 to an open top end of the housing effectively dividing the internal cavity into the chambers.

Figure 2:
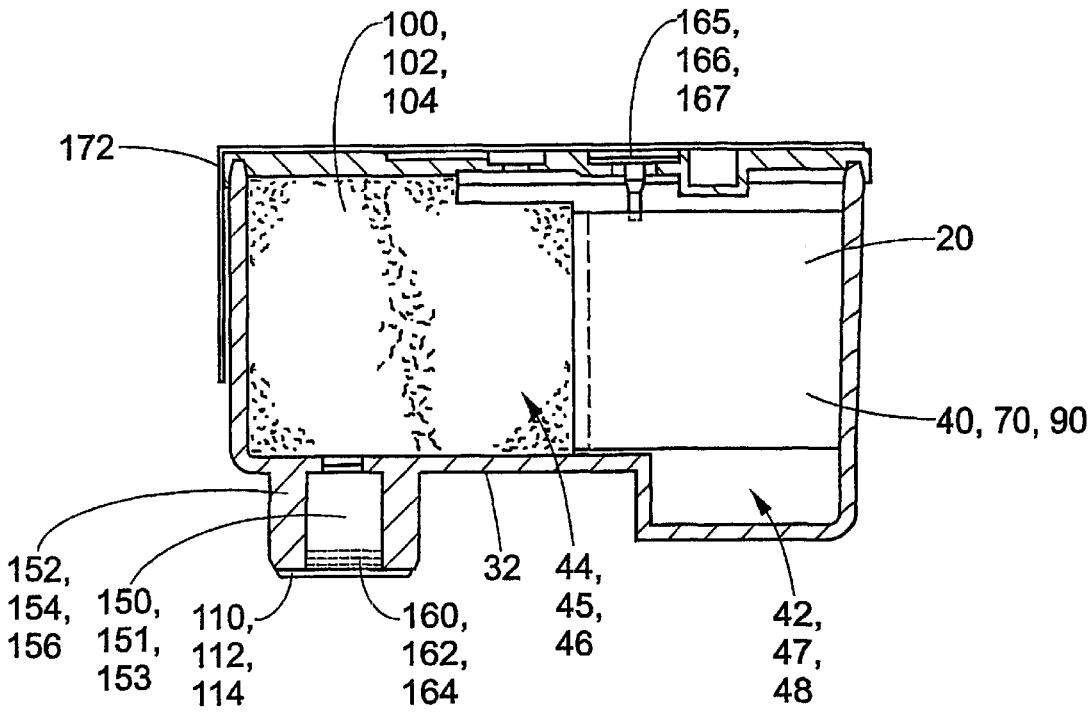
FIG. 2 is a side elevational view in cross-section of the ink cartridge of FIG. 1.
Figure 4:
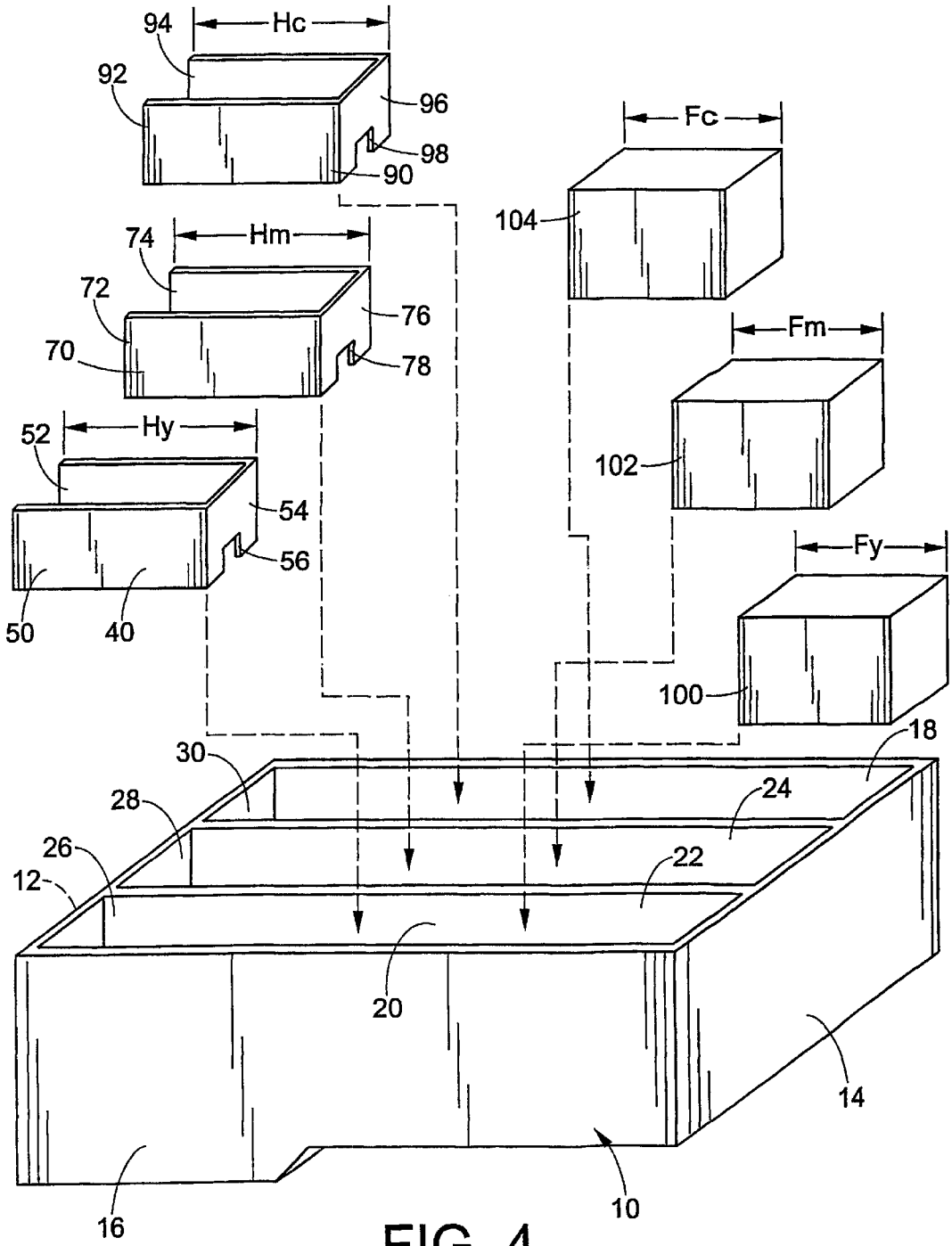
FIG. 4 is an exploded perspective view of the cartridge showing spacer walls and foam blocks; and, FIG. 5 is a chart illustrating ink formulas versus viscosity.

Each chamber 26, 28, 30 is further divided into two smaller sub-chambers. As shown in FIG. 4, a removable wall or spacer insert 40 is placed within chamber 26 to divide it into two discrete smaller sub-chambers 42, 44 (See FIG. 2). The removable wall or spacer 40 is substantially U-shaped and comprises two leg portions 50, 52 which are spaced apart and generally parallel to each other. The leg portions are connected to each other by a wall 54 which is generally normal to the legs. The spacer is bent or folded along two score lines provided at the juncture of the wall and the leg portions whereby the spacer adapts to the generally U-shaped conformation. As shown in the figure, the wall spacer 40 is U-shaped; however, the wall may form an alternate shape such as a "T"-shape or an "S"-shape where the two legs 50, 52 would abut opposing side walls within chamber 26 or a wall in sub-chamber 42 and a wall in sub-chamber 44. Wall 54 has a notch or opening 56 located adjacent a bottom surface of the wall to allow the two sub-chambers 42, 44 to communicate with each other. The spacer is inserted into the housing with the wall spaced from a first or forward portion of the housing and the legs extending toward a second or rearward portion and in close proximity to opposed side walls 16, 18 of the housing.

Similarly, chamber 28 is further divided into two substantially equally sized smaller sub-chambers 45, 47 by a wall spacer 70. Wall spacer 70 includes two leg portions 72, 74 which are spaced apart and generally parallel to each other. These two legs are joined by a wall 76 which is substantially normal to legs 72, 74. Wall 76 further comprises a notch or opening 78 which is disposed adjacent a bottom surface of the wall.

Chamber 30 is similarly divided into two smaller sub-chambers 46, 48 by a wall or spacer 90. Wall 90 has two legs 92, 94 which are spaced apart and generally parallel to each other. These legs are joined by wall 96 which is substantially normal to these two walls and hingedly connected to the two walls in a manner akin to the spacers described above. Wall 96 has a notch or opening 98 adjacent a bottom surface of the wall which allows communication between the sub-chambers. All three spacers 40, 70, 90 are installed into the three chambers in the same orientation (FIG. 4).

Figure 3:
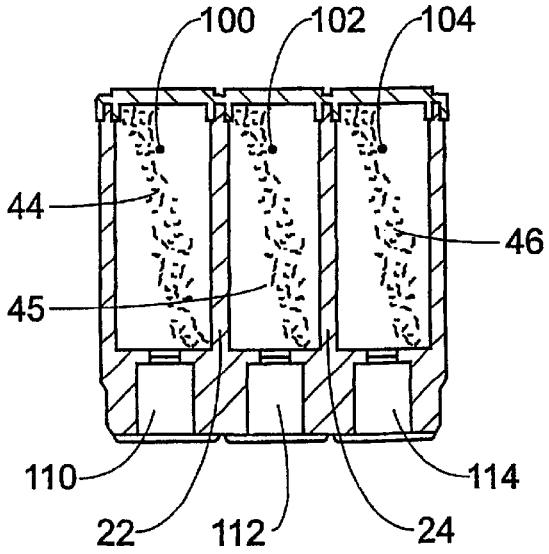
FIG. 3 is a front elevational view in cross-section of the interior of the ink cartridge of FIG. 1.

Ink absorbing member or foam block 100 is installed in the sub-chamber 44 which is formed by the wall 54 of the spacer and the walls 14, 16, 22 of the cartridge. That is, the ink absorbing member is not installed in the sub-chamber which includes the leg members of the U-shaped spacers. Likewise, an ink absorbing member or foam block 102 is installed in a second sub-chamber 45 parallel to sub-chamber 44, and an ink absorbing or foam member 104 is installed in a third sub-chamber 46 parallel to sub-chamber 44 (See FIG. 3). As more clearly evident in FIG. 4, each of the porous foam block members are approximately rectangular in cross-sectional dimension and are all approximately the same size. The foam blocks are installed above ink outlet ports 110, 112, 114 which are located along the bottom wall 32 of the housing (See FIG. 3). The other sub-chambers 42, 47, 48 are used to store free ink. Each of the ink absorbing members is preferably formed of Melamine™ or hydrophilic foam. Filters or screens 130, 132, 134 are usually inserted over the ink outlet ports and below the ink absorbing members. The screens are interposed between the ink absorbing members and the outlet ports to prevent egress of air bubbles, contaminants, and the like from the cartridge.

After the ink absorbing members have been installed and properly positioned in each respective sub-chamber, a cover 140 is fixedly secured to the housing by ultrasonic welding. The sub-chambers at that point are fluidically segregated from each other.

Seal members or grommets 150, 151, 153 are inserted into each ink outlet port 110, 112, 114 through external pipe-like members or chimneys 152, 154, 156 into openings 157, 158, 159. Each grommet is somewhat cup-shaped and is disposed with an open end facing the interior of the cartridge. A closed end faces the outside of the chimney and is pierced by a needle extending from an associated printer (not shown) to create an ink supply or withdraw opening only when and as the cartridge is installed into a printer. The structural and functional details of the interaction between the ink cartridges and the printer are well known to one skilled in the art so that further discussion herein is unnecessary to a full and complete understanding of the present invention. Grommet retaining rings 160, 162, 164 are placed over the other end of the chimneys and located over each grommet. The grommet retaining rings are secured into place, such as by ultrasonically welding, to assure that the grommets are properly retained within the chimneys.

The sub-chambers and foam blocks are exposed to a pre-vacuum of 27.5 in Hg. The cartridge chambers filled with ink through respective fill holes 165, 166, 167 of the cover using degassed ink. The ink is introduced under pressure into the cartridge to maximize the amount of ink for consumer end use and minimize the likelihood of air bubble entrapment. Check valves 168, 169, 170 are installed in the fill holes to form a seal. The cartridge is then inserted into a fixture to seal the cartridge with seal 172 prior to shipping and storage. The height of each ink absorbing members is slightly less than the inside height of the housing as measured between the bottom wall and the underside of the cover. Thus, there is no compression of the ink absorbing members in the vertical direction.

Preferably, each ink absorbing member has pore sizes which are larger than those in the filter screens. The ink absorbing members have a cross-sectional area slightly greater than the cross-sectional area of the sub-chambers into which they are installed. Each ink absorbing member 100, 102, 104 is thereby compressed along three sides of the internal chambers which are formed by the walls of the housing as well as the spacer walls 40, 70, 90. Alternately, a solid integrally molded wall may be provided within the housing which is permanently attached to the housing and separates the chambers 26, 28, 30 into sub-chambers. As shown in FIG. 4, the walls 40, 70, 90 are the walls which provide compression along three of the four sides of each foam block against the ink absorbing members.

Each U-shaped wall is shown to be approximately the same length and dimension. However, the lengths vary according to ink viscosity. As noted above, each ink color has a different viscosity. The inks in the various sub-chambers are typically cyan, magenta, and yellow inks. As an example, yellow ink typically has a viscosity of about 2.70–2.30 cp (centipose). Magenta ink has a viscosity of about 3.10–3.70 cp. Cyan ink, on the other hand, has a viscosity ranging from about 3.00–3.60 cp. Under the same temperature and pressure conditions, yellow ink would flow the fastest since it has the lowest viscosity; that is, the lower the cp value the thinner the ink. In contrast, magenta ink would be the thickest ink with the lowest flow rate since it has the highest viscosity number.

To overcome the varying ink viscosities and resulting different flow rates, the length of each spacer is slightly varied so that the ink absorbing member which is used with thinner ink is compressed more than the ink absorbing members used with thicker inks. That is, the ink absorbing member used with magenta ink would be compressed the least and the ink absorbing member used with yellow ink would be compressed the most. These compressions would be based proportionately on the differences in the viscosity ranges. Thus, in a cartridge with a molded wall or spacer, the dimensions required for compressing the ink absorbing members would be built into the mold or the design of the wall spacers.

In a U-shaped wall system, such as shown in FIG. 4, the compression amount for the ink absorbing members would be adjusted by the lengths of the U-shaped walls. These lengths are indicated by $H_C$, $H_M$, and $H_Y$ as shown in FIG. 4. $H_C$ would correspond to cyan ink, $H_M$ would correspond to magenta ink, and $H_y$ would correspond to yellow ink. Furthermore, the dimensions of the foam blocks are indicated as $F_y$, $F_m$, and $F_c$. The various chamber lengths formed by the differently dimensioned spacers would allow for each ink color to maintain essentially the same flow rate to the printhead.

Figure 5:
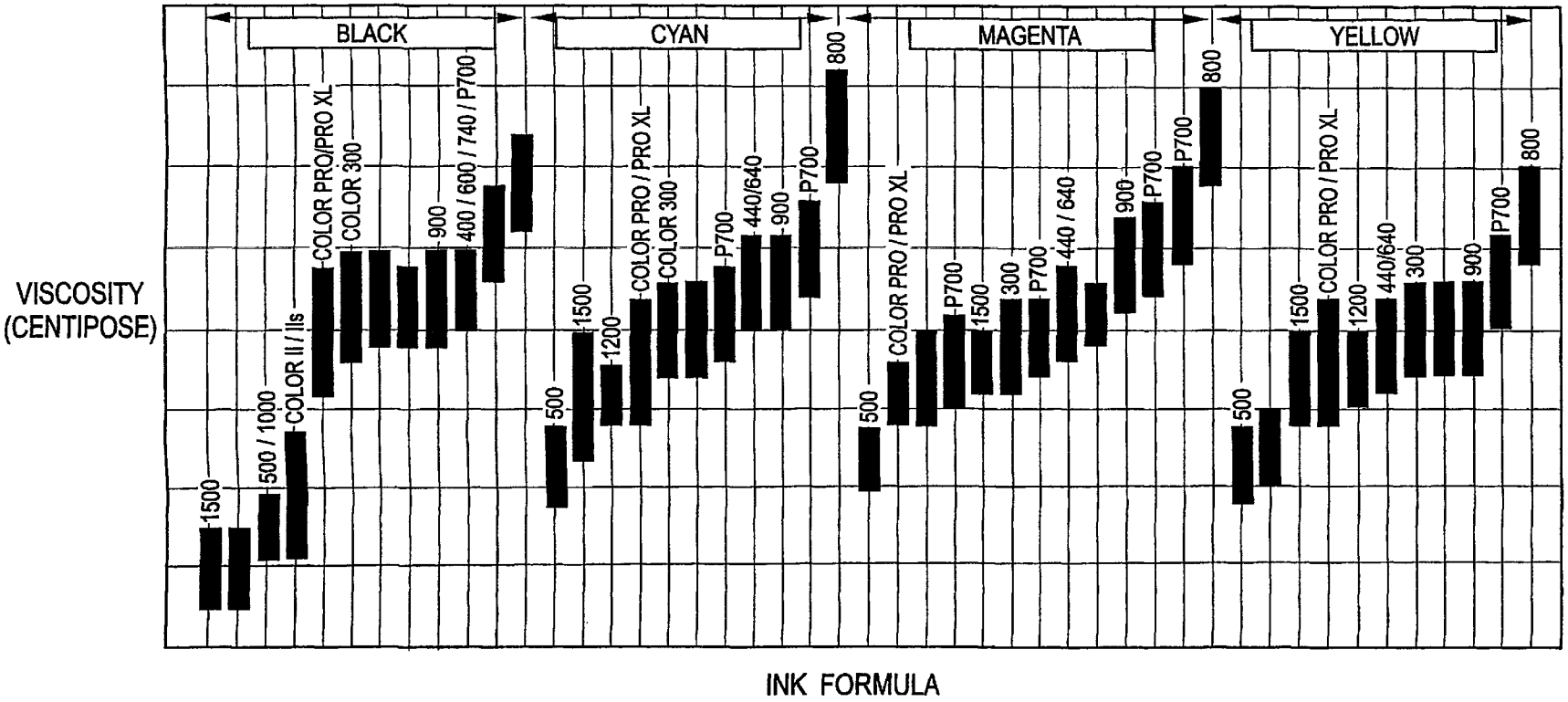

Referring to FIG. 5, the different viscosities in centipose (cp) are illustrated for various ink colors such as black, cyan, magenta, and yellow. The chart illustrates the ink formulae versus viscosity. As seen in the chart, yellow ink has the lowest viscosity valve and magenta and cyan have higher viscosity values. Thus, for yellow ink, the length of the spacer, $H_y$, would be increased to provide greater compression of the foam block, thus, reducing the dimension $F_y$ of the foam in an installed condition. In contrast, the length of the divider wall, $H_m$ used with magenta ink would be shortened to provide a greater dimension $F_m$ than $F_y$. Similarly, the length of spacer, $H_c$, is shorter for the cyan ink to allow for a greater dimension $F_c$ than $F_y$. As a result, the inks all flow at approximately the same rate.

It will be appreciated that this is one preferred manner of regulating ink flow where inks of different viscosities are provided to a printhead. Compressing foam blocks to different levels in proportion to the viscosity of the ink, is one method for controlling flow rate of the ink. For example, one skilled in the art will appreciate that other means for providing flow rate for different inks can be achieved without departing from the present invention.

The invention has been described with reference to the preferred embodiment. Obviously, alterations and modifications will occur to others upon a reading and understanding of the specification. For example, different structures for achieving different compression of the individual foam blocks can be used as an alternative to the U-shaped wall system or spacers. It is intended to include all such modifications and alterations insofar as they come within the scope of the appended claims or the equivalents thereof.

Having thus described the preferred embodiments, it is claimed:

1. An ink tank cartridge for an associated ink-jet recording apparatus comprising:

a housing having a plurality of walls forming a cavity;

a first divider wall dividing said cavity into chambers;

a pair of spacers further dividing each chamber into sub-chambers; and, first and second ink absorbing members each of which is inserted into one of said sub-chambers formed by said spacers, wherein said ink absorbing members are compressed by said spacers to regulate the flow of ink through said ink absorbing members.

2. The ink tank cartridge of claim 1 further comprising a second divider wall which further divides the cavity of said housing along with said first divider wall into first, second, and third chambers.

3. The ink tank cartridge of claim 2, wherein said first, second and third chambers are substantially equilisized.

4. The ink tank cartridge of claim 3 further comprising a third spacer inserted into said third chamber for dividing said third chamber into substantially equally sized sub-chambers.

5. The ink tank cartridge of claim 4, further comprising a third ink absorbing member, said ink absorbing member is inserted into said one of said sub-chambers of said third chamber.

6. The ink tank cartridge of claim 1, wherein each removable spacer comprises a first leg, a second leg, and a wall hingedly connected between said legs, said first and second legs being spaced apart and substantially parallel to each other.

7. The ink tank cartridge of claim 6, wherein each wall of each spacer includes a notch for permitting ink to flow from one sub-chamber to another sub-chamber.

8. The ink tank cartridge of claim 7, wherein said chambers are filled with inks of different viscosities.

9. The ink tank cartridge of claim 8, wherein said ink absorbing members are compressed in proportion to the viscosity of said ink carried by each ink absorbing member.

10. The ink tank cartridge of claim 9, wherein said first and second legs of said spacer in the chamber containing the ink of highest viscosity have a longer length than said legs of said spacer in said chamber with ink of lowest viscosity.

11. The ink tank cartridge of claim 10, wherein the first and second legs of longest length provide greater compression for their corresponding ink absorbing member carrying the ink of highest viscosity and the first and second legs of the shortest length provide less compression on the corresponding ink absorbing member carrying ink of the lowest viscosity.

12. An ink tank cartridge for an ink-jet type recording apparatus comprising:

a housing having a plurality of walls forming a cavity;

first and second divider walls dividing said cavity into first, second, and third chambers;

first, second, and third spacers further dividing each chamber into sub-chambers, each spacer comprises a first leg, a second leg, and a wall hingedly connected between said legs; and, first, second, and third ink absorbing members, each of which is inserted into one of said sub-chambers formed by said spacers, wherein said ink absorbing members are compressed by said spacers to regulate the flow of ink through said ink absorbing members.

13. The ink tank cartridge of claim 12, wherein each wall of each said spacer includes a notch for permitting ink to flow from one sub-chamber to another sub-chamber.

14. The ink tank cartridge of claim 12, wherein each spacer is selectively removable from each chamber.

15. An ink tank cartridge for an ink-jet type recording apparatus comprising;

a housing comprising a plurality of walls forming a cavity;

first and second divider walls dividing said cavity into first, second, and third chambers;

first, second, and third removable spacers each of which is inserted into one of said chambers, said spacers further divide each chamber into substantially equally sized smaller sub-chambers;

first, second, and third ink absorbing members each of which is inserted into one of said sub-chambers formed by said spacers;

wherein said ink absorbing members are impregnated with ink of differing viscosities;

wherein lengths of said spacers vary in proportion to the viscosities of the inks impregnated in said ink absorbing members;

wherein said ink absorbing members are compressed by said spacers in proportion to the viscosities of the inks within said ink absorbing members.

16. A method of controlling ink flow in a multi-chambered ink cartridge containing inks of different viscosities, the method comprising the steps of:

storing ink in ink absorbing members in respective chambers of the ink cartridge; and, regulating a flow rate of ink stored in the ink absorbing members in proportion to the ink viscosity.

17. The method of claim 16 wherein the regulating includes the compressing the ink absorbing member containing an ink with a higher viscosity to a greater degree than the ink absorbing member containing an ink with a lower viscosity.

18. The method of claim 16 wherein the regulating step includes the step of compressing the ink absorbing members to different levels so that the different viscosity inks all flow at approximately the same rate.

* * * * *